US008844726B2

(12) United States Patent
Andre et al.

(10) Patent No.: US 8,844,726 B2
(45) Date of Patent: Sep. 30, 2014

(54) CORD AND RETAINER SYSTEM, AND ASSOCIATED METHODS

(75) Inventors: Bartley K. Andre, Menlo Park, CA (US); Michael Korinek, San Francisco, CA (US); Mikael Silvanto, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/492,907

(22) Filed: Jun. 10, 2012

(65) Prior Publication Data

US 2013/0327681 A1 Dec. 12, 2013

(51) Int. Cl.

| | |
|---|---|
| ***B65D 85/00*** | (2006.01) |
| ***B65D 85/02*** | (2006.01) |
| ***B65D 65/02*** | (2006.01) |
| ***B65D 85/04*** | (2006.01) |
| ***B65D 5/04*** | (2006.01) |
| ***B65B 43/10*** | (2006.01) |
| ***B65D 65/12*** | (2006.01) |

(52) U.S. Cl.

CPC ..... *B65D 85/00* (2013.01); *B65D 65/02* (2013.01); *B65D 85/04* (2013.01); *B65D 5/04* (2013.01); *B65B 43/10* (2013.01); *B65D 65/12* (2013.01)

USPC ..... 206/702; 206/303; 206/388; 206/408

(58) Field of Classification Search

USPC ..... 206/225, 226, 303, 305, 320, 388, 408, 206/419, 420, 702; 242/159, 388.1–388.6, 242/398–407.1, 588.3, 588.4

See application file for complete search history.

(56) References Cited

U.S. PATENT DOCUMENTS

| | | | | |
|---|---|---|---|---|
| 2,458,898 | A * | 1/1949 | Di Addario | 206/226 |
| 2,812,854 | A * | 11/1957 | Fletcher | 206/395 |
| 3,796,304 | A * | 3/1974 | Blais | 206/702 |
| 4,019,636 | A * | 4/1977 | Wise | 206/396 |
| 4,824,041 | A * | 4/1989 | Myers | 242/159 |
| 5,129,514 | A * | 7/1992 | Lilley, Jr. | 206/388 |
| 6,467,623 | B1 * | 10/2002 | Lewis et al. | 206/388 |
| 7,306,101 | B2 * | 12/2007 | Murry | 206/408 |
| 2007/0051662 | A1 * | 3/2007 | Millar-Sax et al. | 206/702 |

* cited by examiner

*Primary Examiner* — Bryon Gehman

(74) *Attorney, Agent, or Firm* — Sterne, Kessler, Goldstein & Fox P.L.L.C.

(57) ABSTRACT

Some embodiments disclosed herein provide a cord and retainer system including a cord retainer that retains a cord within a desired configuration. The cord retainer may be a paper element extending around a coiled cord. The cord retainer may promote the structural integrity of the coiled arrangement of the cord, and may have an aesthetically pleasing appearance (e.g., due to having edges that do not expose the internal structure of the material forming the cord retainer. In some embodiments, a second cord (optionally having its own cord retainer) is disposed within coils of the first coiled cord. In some embodiments, one or both of the first and second cord are disposed within one or more cavities of a packaging substrate, to fix their positions in a manner easily understood by a user, to enhance the user's experience upon unpacking the cords.

19 Claims, 12 Drawing Sheets

CORD AND RETAINER SYSTEM, AND ASSOCIATED METHODS

BACKGROUND

1. Field

Embodiments disclosed herein relate to cords. In particular, embodiments disclosed herein relate to cord and packaging systems, and associated methods.

2. Background

Many products utilize cords in some form or another. For example, an electronic device may utilize one or more cords to receive or transmit power or data (e.g., audio or video signals). At times it may be desirable to store the cords (e.g., between uses, in transit, while presented for sale).

SUMMARY

A length of cord may be coiled upon itself any suitable number of times such that adjacent coil windings are flush with one another. In other words, the cord may be hanked. One or both ends of the cord may terminate inside the coil windings. A cord retainer can be wrapped around the coiled cord and secured to itself (e.g., with an adhesive), to help maintain a coiled shape of the coiled cord.

Some embodiments disclosed herein provide a cord and retainer system including a cord retainer that retains a cord within a desired configuration. The cord retainer may be a paper element extending around a coiled cord. The cord retainer may promote the structural integrity of the coiled arrangement of the cord, and may have an aesthetically pleasing appearance (e.g., due to having edges that do not expose the internal structure of the material forming the cord retainer). In some embodiments, a second cord (optionally having its own cord retainer) is disposed within coils of the first coiled cord. In some embodiments, one or both of the first and second cord are disposed within one or more cavities of a packaging substrate, to fix their positions in a manner easily understood by a user, to enhance the user's experience upon unpacking the cords.

Some embodiments disclosed herein provide two or more coils nested together. For example, a cord and retainer system according to exemplary embodiments disclosed herein may include a first coiled cord having a plurality of coil windings, a second coiled cord separate from the first coiled cord, having a plurality of coil windings, wherein the second coiled cord is encircled by the first coiled cord, and packaging for retaining the first coiled cord and the encircled second coiled cord.

Some embodiments disclosed herein provide a cord and retainer system having a cord retainer formed of a flat material into a loop by overlapping ends of the flat material, and a coiled cord disposed within the cord retainer.

Some embodiments disclosed herein provide a cord retainer having unexposed internal material structure. For example, a cord and retainer system according to exemplary embodiments disclosed herein may include a cord retainer formed of a flat material into a loop having edges formed by folds in the flat material, and a coiled cord disposed within the cord retainer.

Some embodiments disclosed herein provide a blank for forming a cord retainer, where the blank includes a central series of rectangular panels, each panel of the central series of panels connected to an adjacent panel of the central series of panels by an upward fold line, a first outer series of rectangular panels, each panel of the first outer series of panels connected to an adjacent panel of the first outer series of panels by a downward fold line, and a second outer series of rectangular panels, each panel of the second outer series of panels connected to an adjacent panel of the second outer series of panels by a downward fold line, wherein the central series of panels is connected to the first outer series of panels by an upward fold line along a first side of the central series of panels, wherein the central series of panels is connected to the second outer series of panels by an upward fold line along a second side of the central series of panels, and wherein the downward fold lines connecting the first outer series of panels and the downward fold lines connecting the second outer series of panels are aligned with the upper fold lines connecting the central series of panels.

Some embodiments disclosed herein provide a method for assembling a cord and retainer system, the method including forming a first cord into a coil, forming a second cord into a coil, wherein the second cord formed into a coil has a coiled portion and an uncoiled portion extending from the coiled portion to an electronic component, forming a first cord retainer, forming a second cord retainer, sliding the coiled portion of the second cord into the second cord retainer, positioning the coil of the first cord about the exterior of the coiled portion of the second cord, and sliding the first cord and the coiled portion of the second cord into the first cord retainer.

Additional features of embodiments of the invention will be set forth in the description that follows, and in part will be apparent from the description, or may be learned by practice of embodiments of the invention. Both the foregoing general description and the following detailed description are exemplary and explanatory and are intended to provide further explanation of the invention as claimed.

BRIEF DESCRIPTION OF THE FIGURES

The accompanying figures, which are incorporated herein, form part of the specification and illustrate embodiments disclosed herein.

DETAILED DESCRIPTION

Figure 1:
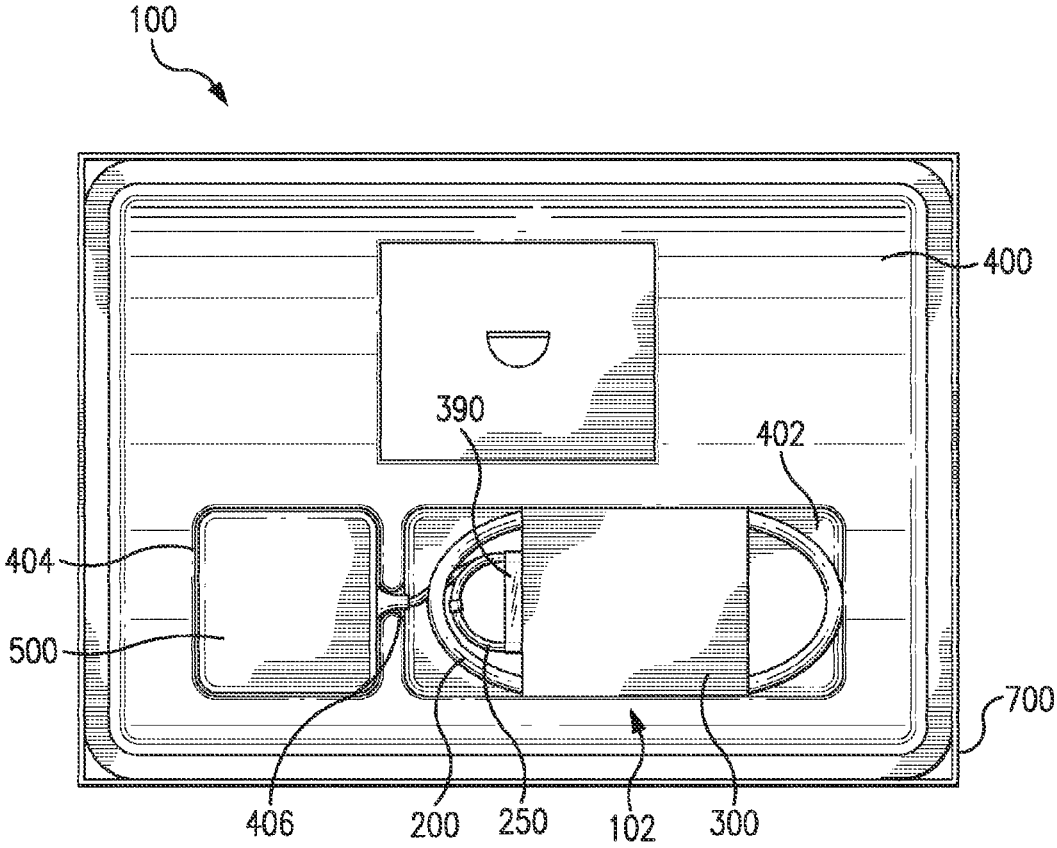
FIG. 1 illustrates a top view of a cord and retainer system, according to an embodiment presented herein.
Figure 2:
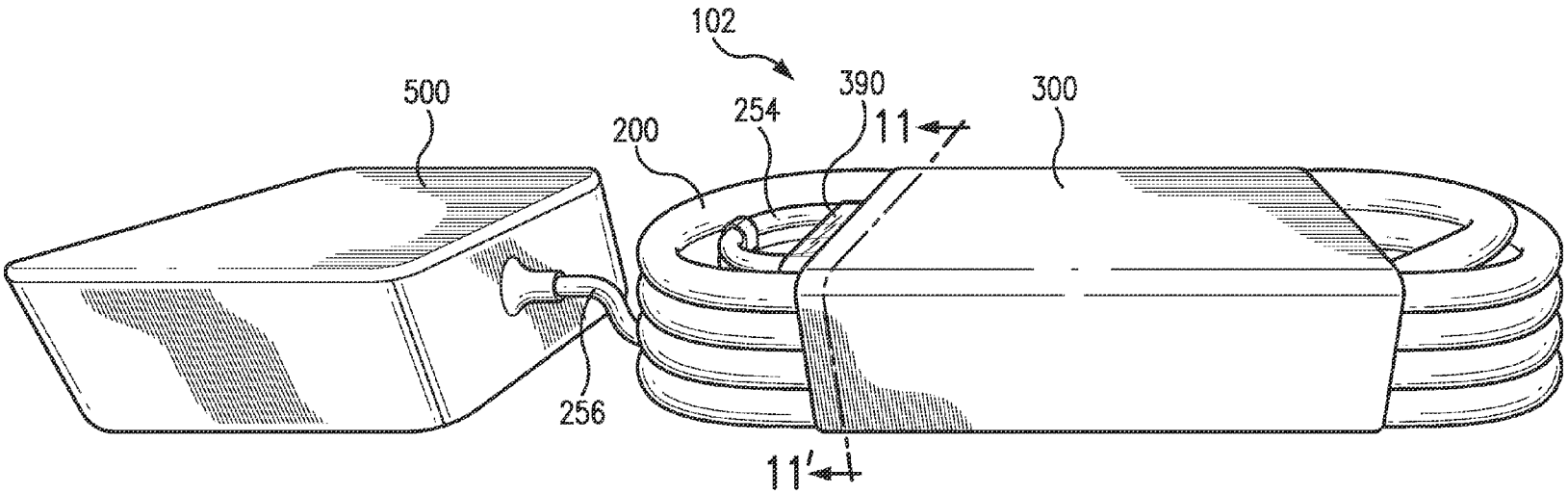
FIG. 2 illustrates a perspective view of a cord and retainer system, according to an embodiment presented herein.

Embodiments will now be described in detail with reference the accompanying drawings, in which like reference numerals are used to indicate identical or functionally similar elements. References to an "embodiment" or "embodiments" indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following embodiments are illustrative, but not limiting, of the present invention. Other suitable modifications and adaptations of the variety of conditions and parameters normally encountered in the field, and which would be apparent to those skilled in the art, are within the spirit and scope of the invention.

A user (e.g., manufacturer, distributor, transporter, retailer, end user) of a cord may at times desire to store the cord. A cord (which may also be referred to as a cable) typically has a length many times greater than its width. Thus, a cord may be manipulated into a compact configuration to occupy a compact area, in order to efficiently store the cord. For example, a cord may be folded, bunched together, or coiled into such a compact configuration. Such a compact configuration may facilitate, for example, storage and transport of a cord. Packaging may be provided to maintain a cord in a compact configuration (e.g., a cavity in a packaging substrate, or a standalone cord retainer).

An embodiment of a cord and packaging system 100 is depicted in FIG. 1. In this embodiment, a first cord 200 and a second cord 250 are disposed in a cavity 402 of packaging, in this case packaging substrate 400. Further packaging, first cord retainer 300, is disposed about the first cord 200, and further packaging, second cord retainer 390, is disposed about the second cord 250. In this embodiment, the second cord 250 is coupled to an electronic component 500.

In some embodiments, the first and second cords 200, 250 may be cords to receive or transmit power or data (e.g., audio signals). In some embodiments, the first and second cords 200, 250 may have substantially circular transverse cross-sections (see, e.g., FIG. 10).

As shown in FIG. 1, in some embodiments, the packaging substrate 400 is disposed within a box 700. In some embodiments, the packaging substrate 400 is not disposed within a box. The box 700 may mate with or otherwise include a box top (not shown) that can be used to enclose and cover items within the box 700, including, for example, those shown in FIG. 1.

The presentation of items to a user upon opening a box can influence the user's understanding of and ability to put to use products and/or systems therein contained, and can create a favorable or unfavorable impression in the mind of the user. It may be desired to arrange items within box 700 so as to facilitate the user's understanding and use of products and/or systems therein contained, and to create a favorable impression in the mind of the user. Such qualities can promote a positive user experience. Cavities (e.g., cavity 402) can be arranged as desired in substrate 400 to determine and fix the positions of elements (including the first and second cords 200, 250) to be inserted therein.

In some embodiments, to promote a positive user experience, a cord can be coiled (i.e., looped on itself any suitable number of times) into a compact configuration, which may facilitate its storage within a compact cavity. For example, the first cord 200 and the second cord 250 are shown coiled in FIG. 1, and are disposed within a cavity of the packaging substrate 400. The coiled cord may have roughly integer or half-integer windings (e.g., be looped in roughly integer or half-integer increments) that result in an "even" or "uneven" coil, respectively, which may affect how well ends of the cords (which may include connectors) can fit within the windings of the coiled cords.

An uneven coil (e.g., one with more winds of the cord on one side than the other) may allow ends of the cords to be hidden within the coil windings (which may also be referred to as loops) of the unevenly coiled cord (e.g., first coiled cord 200 or second coiled cord 250) more easily than if the coiled cord had an even coil. This is because each cord end in an unevenly coiled cord enters the void created within the coil windings of the coiled cord from opposing sides in both the vertical and lateral directions. In some embodiments, one or both of the first coiled cord 200 and the second coiled cord 250 has an uneven coil (see, e.g., FIGS. 3 and 4). In some embodiments, one or both of the first coiled cord 200 and the second coiled cord 250 has an even coil.

An embodiment of a cord and packaging system 102 is depicted in FIGS. 2-6. In some embodiments, the cord and packaging system 102 is a part of the cord and packaging system 100 (see, e.g., FIG. 1). As shown in FIGS. 2-6, in some embodiments the first cord 200 is coiled (including where a portion less than the entirety of the first cord 200 defines the coil) so as to include one or more coil windings, for example, between two and ten coil windings, between three and five windings, about four coil windings, or about four and one-half coil windings. In some embodiments, the second cord 250 is coiled (including where a portion less than the entirety of the second cord 250 defines the coil) so as to include one or more coil windings, for example, between two and twenty coil windings, between six and ten coil windings, about eight coil windings, or about eight and one-half coil windings. In some embodiments, the second coiled cord 250 includes a greater number of coil windings than the first coiled cord 200. In some embodiments, the first coiled cord 200 includes a greater number of coil windings than the second coiled cord 250. In some embodiments, the first cord 200 has a greater width (i.e., greater transverse cross-sectional area) than that of the second cord 250. In some embodiments, the second cord 250 has a greater width than that of the first cord 200.

In some embodiments, each of the first coiled cord 200 and the second coiled cord 250 are coiled by winding the cord a plurality of times about a winding fixture. The winding fixture can include a base member with an adjustable stage having a pair of mandrels that are configured to extend perpendicularly from the base member. The mandrels may be movable relative to each other to facilitate varying the distance between the mandrels and, therefore, accommodating cords of different lengths. The mandrels may be sized and positioned to correspond to a desired interior size and shape of the resulting coiled cord wound thereabout. Exemplary techniques for forming coiled cords are shown and described in U.S. Provisional Patent Application No. 61/577,588, filed Dec. 19, 2011, titled "Systems and Methods for Hanking a Cable." This application is incorporated by reference herein in its entirety.

Figure 6:
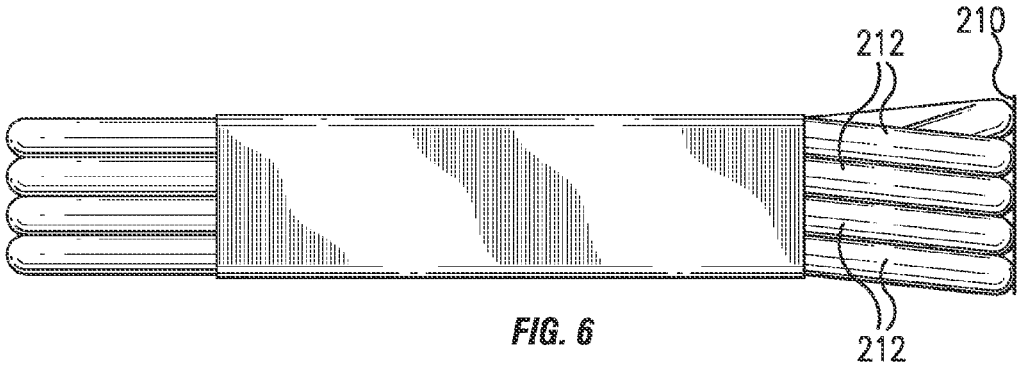
FIG. 6 illustrates a front view of a cord and retainer system, according to an embodiment presented herein.

In some embodiments, each of the first coiled cord 200 and the second coiled cord 250 may be wound such that subsequent windings do not cross previous windings. Such winding may result in vertically-aligned coil windings 212 (i.e., windings that are flush with one another) defining the first coiled cord 200 or vertically-aligned coil windings defining the second coiled cord 250, and may provide a neat, clean coil. In some embodiments only one of the first coiled cord 200 and the second coiled cord 250 define vertically-aligned coil windings. In some embodiments, both of the first coiled cord 200 and the second coiled cord 250 define vertically-aligned coil windings FIG. 6 shows the vertical alignment of the vertically-aligned coil windings 212 of the first coiled cord 200, where external sides of adjacent windings 212 are equidistant from (or flush against) an imaginary vertical line 210 oriented parallel to a coil axis of the first coiled cord 200. In other words, when viewed from the top (see, e.g., FIG. 3), coil windings below an uppermost coil winding will be substantially hidden by the uppermost coil winding. In other words, in the case where the first cord 200 has a circular cross-section, outermost extents of coil windings 212 of the first coiled cord 200 will substantially share the same tangent line. (For clarity, the electronic component 500 has been omitted in FIG. 6.)

The first cord 200 may terminate at opposing ends thereof, which may include or be coupled to, for example, connectors or other electronic elements. For example, a first end of the first cord 200 may terminate in the form of a plug for insertion into a power source (e.g., a wall socket). In some embodiments, a second end of the first cord 200 may terminate in a connector suitable to mate with another element, for example, to provide power thereto. For example, the second end of the first cord 200 may be configured to mate with and provide power to the second cord 250 (e.g., via electronic component 500), or to an electronic device (e.g., a laptop, a personal computer, a television, a stereo, a toaster).

Ends of the first cord 200 may be disposed within coil windings of the first cord 200, when the first cord 200 is coiled. Such a configuration can further promote the compactness of the first cord 200 in the coiled configuration.

The second cord 250 may terminate at opposing ends thereof, which may include or be coupled to, for example, connectors or other electronic elements. For example, a first end of the second cord 250 may terminate in the form of a connector, or an electronic component (e.g., the electronic component 500, which may be, for example, a power adapter) having a connector, suitable to mate with another element, for example, to receive power therefrom. For example, the first end of the second cord may be configured to mate with and receive power from the first cord 200. In some embodiments, a second end of the second cord 250 may terminate in a connector suitable to mate with and provide power to an electronic device (e.g., a laptop, a personal computer, a stereo, a toaster).

Thus, in some embodiments, the first cord 200 and the second cord 250 are separate cords configured to mate together to together provide power to an electronic device. For example, the first cord 200 may be an AC (alternating current) power cord, and the second cord 250 may be a DC (direct current) power cord. As noted elsewhere herein, the electric component 500 may be a power adapter, which may be capable of adapting AC power to DC power, and may form part of a connector between the first cord 200 and the second cord 250.

Ends of the second cord 250 may be disposed within coil windings of the second cord 250, when the second cord 250 is coiled. Such a configuration can further promote the compactness of the second cord 250 in the coiled configuration. In some embodiments, one end of the second cord extends outside coil windings thereof, when the second cord 250 is coiled. For example, an end of the second cord 250 may terminate at or in the form of the electronic component 500, which may be disposed outside windings of second coiled cord 250 (see, e.g., FIG. 1).

In some embodiments, the first cord 200 may have a greater diameter than the second cord 250. In some embodiments, the first cord 200 may be formed into a coil defining an interior area 202 and the second cord 250 may be formed into a coil defining an interior area 252. In some embodiments, the interior area 202 of the first coiled cord 200 may be greater than the interior area 252 of the second coiled cord 250. In some embodiments, each of the first cord 200 and the second cord 250 may be formed into a coil, where the coils are sized such that the second coiled cord 250 can fit within the interior area 202 defined by the first coiled cord 200.

In some embodiments, the second coiled cord 250 is disposed within the interior area 202 defined by the first coiled cord 200, such that the first coiled cord 200 encircles at least the coiled portion of the second coiled cord 250. In other words, the second coiled cord 250 may be nested within the first coiled cord 200. Such a configuration can efficiently and intuitively utilize available space and can promote compactness and a positive user experience. For example, locating both the first coiled cord 200 and the second coiled cord 250 in a single cavity eliminates the need for two separate cavities to accommodate the two cords. Also for example, where the first cord 200 and the second cord 250 are designed for use together, their packaging together can convey this relationship to a user, and can facilitate their removal from the packaging together.

In some embodiments, the second coiled cord 250 may be non-centrally disposed within the first coiled cord 200 (e.g., a coil axis of the first coiled cord 200 may be offset from a coil axis of the second coiled cord 250). For example, in some embodiments the second coiled cord 250 may be disposed toward an area of the first coiled cord 200 away from ends of the first coiled cord 200, which may terminate in elements disposed within the first coiled cord 200. In some embodiments, coil windings of the nested first coiled cord 200 and second coiled cord 250 are oriented similarly (e.g., a coil axis of the first coiled cord 200 is parallel to a coil axis of the second coiled cord 250).

In some embodiments, the second coiled cord 250 disposed within the interior area 202 may terminate at or in the form of the electronic component 500. In some embodiments, the electronic component 500 is disposed outside of the interior area 202 defined by the first coiled cord 200 (e.g., the electronic component 500 may be too large to fit within the interior area 202 or may be associated with a cavity or retention element disposed outside of the interior area 202). In embodiments where the coiled portion 254 of the second coiled cord 250 is disposed within the interior area 202 and the electronic component 500 is disposed outside of the interior area 202, an uncoiled portion 256 of the second cord 250 may cross the first coiled cord 200 to extend outside the interior area 202, and connect to (or terminate in) the electronic component 500 (see, e.g., FIG. 3).

A coiled cord typically will naturally tend toward a circular shape, to equalize stress (known as "hoop stress") at any point about the coil. In some embodiments, it may be desired to coil a cord in a non-circular shape (e.g., an oval shape, rectangular shape, triangular shape, lozenge shape, pill shape). Exemplary coil shapes are shown and described in U.S. Design patent application Ser. No. 29/408,999, filed Dec. 19, 2011, titled "Cable Hanking"; U.S. Design patent application Ser. No. 29/409,740, filed Dec. 28, 2011, titled "Cable Hanking"; and U.S. Design patent application Ser. No. 29/424,276, filed Jun. 10, 2012, titled "Cords and Packaging". Each of these applications is incorporated by reference herein in its entirety.

In some embodiments, the first coiled cord 200 defines a coil shape having two parallel offset straight sections 204 (shown in phantom in FIG. 3) and two opposing semicircular sections 206, where the semicircular sections 206 extend between and connect the straight sections 204. The straight sections 204 may apply an outward force in the direction of arrows 208, due to the natural tendency toward a circular shape.

In some embodiments having nested coiled cords, a smaller interior coiled cord nested within a larger exterior coiled cord may have the same coil shape as that of the exterior coiled cord. In some embodiments having nested coiled cords, a smaller interior coiled cord nested within a larger exterior coiled cord may have a different coil shape as that of the exterior coiled cord (e.g., a rectangular coil shape within an oval coil shape).

In some embodiments, the first coiled cord 200 is retained in shape by a wrapping member, such as, for example, a first cord retainer 300. The first cord retainer 300 may be a flat element formed into a loop, and disposed about the first coiled cord 200. In some embodiments, the first cord retainer 300 may be disposed about the straight sections 204 of the first coiled cord 200 (e.g., an axis of the loop formed by cord retainer 300 may be substantially perpendicular to a coil axis of the first coiled cord 200). In some embodiments, the first cord retainer 300 may extend over substantially the entire length of the straight sections 204. In some embodiments, the first cord retainer 300 may extend over less than substantially the entire length of the straight sections 204. The first cord retainer 300 may counteract outward force applied by the straight sections 204, and may prevent the straight sections 204 from moving outward (e.g., due to a tendency of the first coiled cord 200 toward a circular shape). In some embodiments, the first cord retainer 300 may be the only element retaining the coil shape of the first coiled cord 200.

In some embodiments, the first cord retainer 300 may be formed of a paper-based material, such as, for example, typical writing paper, solid bleached substrate, corrugated board, chipboard, rigid-box greyboard, and may include paper-based material of varying weights and thicknesses (e.g., tissue paper, cover stock, card stock, and cardboard), or material having a paper base combined or treated with non-paper substances (e.g., wax paper, paper-backed aluminum foil, and gloss paper).

Figure 8:
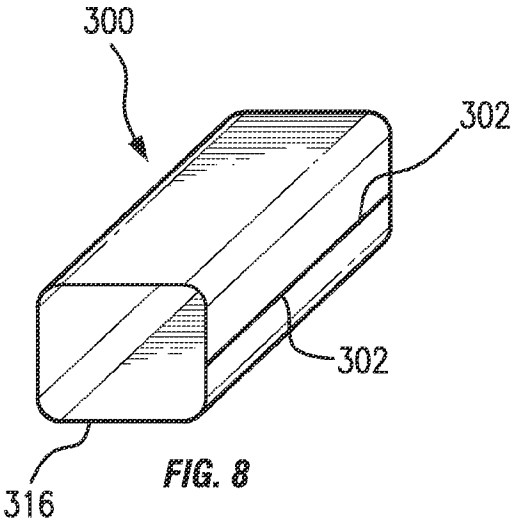
FIG. 8 illustrates a perspective view of a cord retainer, according to an embodiment presented herein.
Figure 9:
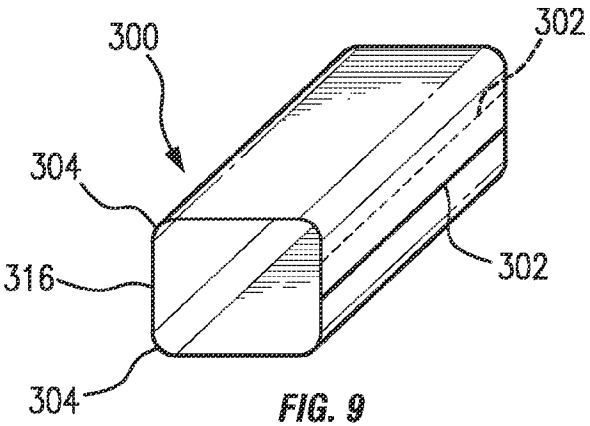
FIG. 9 illustrates a perspective view of a cord retainer, according to an embodiment presented herein.
Figure 7:
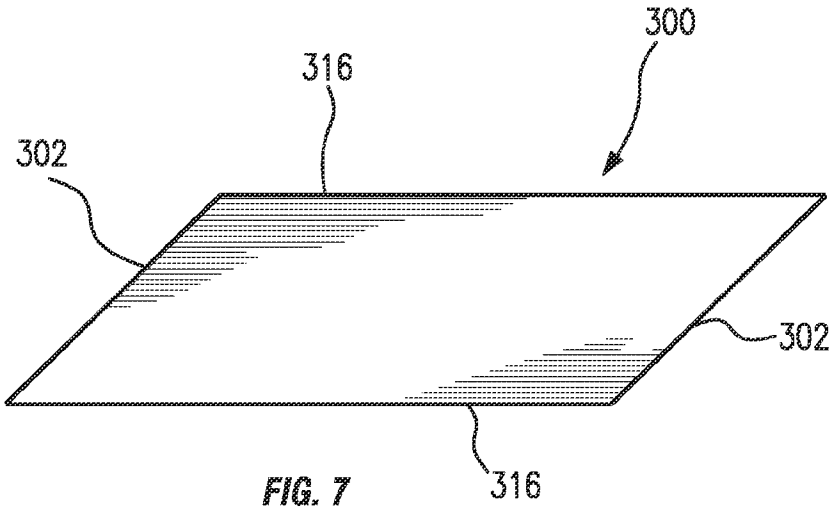
FIG. 7 illustrates a perspective view of a cord retainer, according to an embodiment presented herein.

In some embodiments, the first cord retainer 300 may be formed from a flat, rectangular element having opposite ends 302 (see, e.g., FIG. 7) that have been coupled together to form a loop (see, e.g., FIGS. 8 and 9). Such opposite ends 302 of first cord retainer 300 may abut (see, e.g., FIG. 8) or may overlap (see, e.g., FIG. 9). Such opposite ends may be coupled together by any suitable means, such as, for example, via adhesive (e.g., applied between abutting ends 302, or on overlapping areas of overlapping ends 302).

Figure 5:
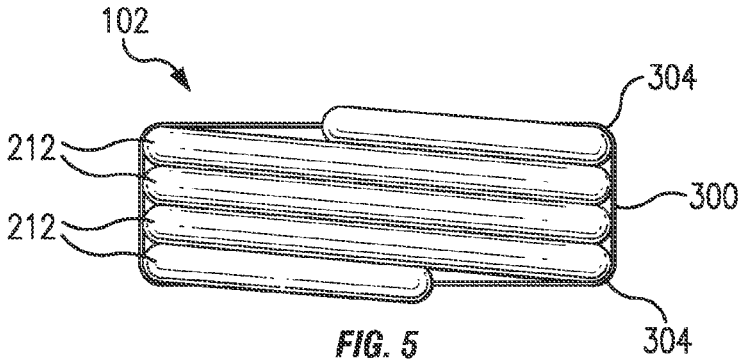
FIG. 5 illustrates a side view of a cord and retainer system, according to an embodiment presented herein.

In some embodiments, the first cord retainer 300 may be formed into a rectangular loop disposed about the first coiled cord 200 (see, e.g., FIG. 5). In some embodiments, such a rectangular loop may have rounded corners 304 to correspond to an outer diameter of the first cord 200.

Figure 10:
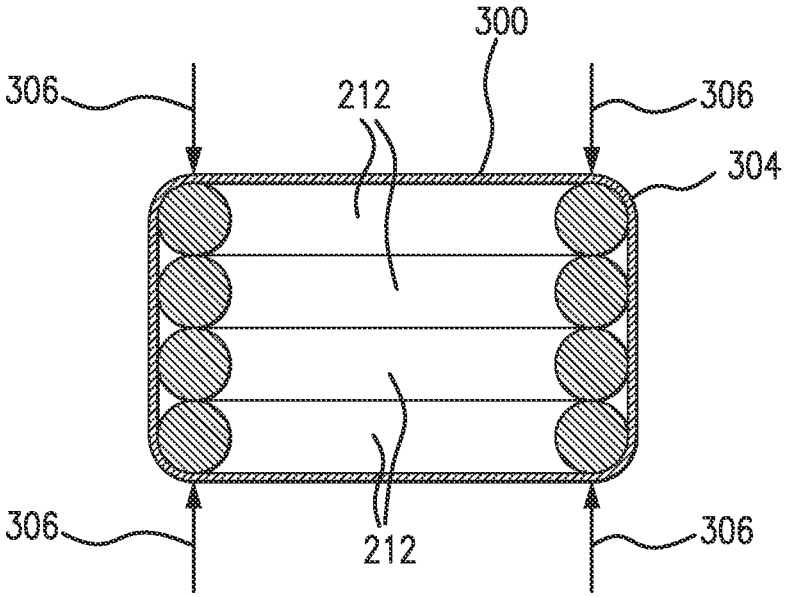
FIG. 10 illustrates a sectional view of a cord and retainer system, taken along line 11-11' in FIG. 2, according to an embodiment presented herein.

In some embodiments, the first cord retainer 300 applies a compressive force between adjacent coils. FIG. 10 shows a cross-sectional view of the cord and retainer system of FIG. 2, and depicts such compressive force. For clarity, the second coiled cord 250 shown in FIG. 2 has been omitted from FIG. 10. For example, where first coiled cord 200 includes vertically-aligned coil windings 212, the first cord retainer 300 may apply a vertical force (e.g., in the direction of arrow 306 in FIG. 10), across the aligned coils, pressing them together. FIG. 10 shows a cross-sectional view of an exemplary cord and retainer system. In some embodiments, the first cord 200 is formed of a compressible material. For example, in some embodiments, the first cord 200 is formed of a thermoplastic-elastomer copolymer (TPE/TPC). Thermoplastic is typically relatively incompressible. The elastomer combined with the thermoplastic provides an elastic material that allows the cords to compress when squeezed (e.g., when squeezed together by a cord retainer in a stacked configuration).

In such embodiments, compressive force applied by the first cord retainer 300 may compress the first coiled cord 200, such that the vertical height of the first coiled cord 200 (i.e., height of all vertically-aligned coil windings 212 of the first coiled cord 200) is less than the vertical height of the first coiled cord 200 would be in the absence of the first cord retainer 300.

Compressive force applied by the first cord retainer can also increase friction between adjacent coil windings of the first coiled cord 200, which may help maintain the vertical arrangement of the coil windings forming the first coiled cord 200. The opposing forces between the first cord retainer 300 and the first coiled cord 200 and the friction between adjacent coil windings can promote structural stability of the cord and retainer system including the first coiled cord 200 and the first cord retainer 300 (e.g., by maintaining the shape and arrangement of the first coiled cord 200 within the first cord retainer 300). In some embodiments, the first cord 200 is formed of a material having a relatively high coefficient of friction. For example, in some embodiments, the first cord 200 is formed of a thermoplastic-elastomer copolymer (TPE/TPC). Thermoplastic typically has a relatively low coefficient of friction. The elastomer combined with the thermoplastic provides material having a relatively high coefficient of friction, which may help maintain the vertical arrangement of the coil windings.

Figure 11:
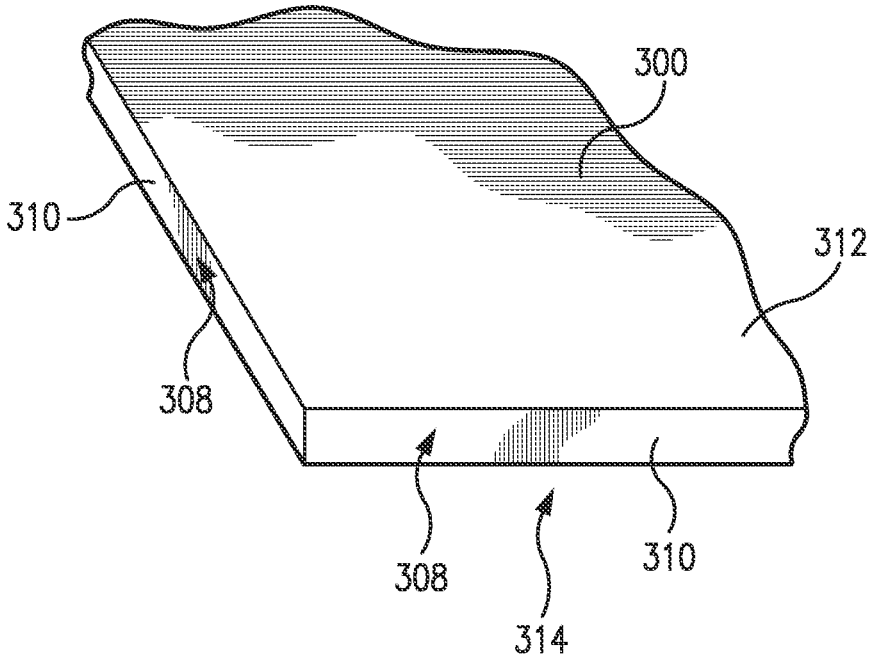
FIG. 11 illustrates an enlarged view of a portion of a cord retainer, according to an embodiment presented herein.

In some embodiments, the flat material forming the first cord retainer 300 includes material edges. For example, FIG. 11 is an enlarged representation of a portion of the flat material forming the first cord retainer 300, and shows material edges 308. For example, the first cord retainer 300 may have been cut or otherwise separated from a larger sheet of the flat material to form the material edges 308. Such separation may expose internal structure 310 of the flat material along the separation. For example, a cut separating portions of a sheet of the flat material will result in exposure, along the material edge(s) 308 created by the cut, of the portion of the flat material disposed between a front surface 312 and a back surface 314 of the flat material (i.e., the internal structure 310).

In some embodiments, the internal structure 310 of the first cord retainer 300 may be less visually appealing than a surface (e.g., front surface 312) of the first cord retainer 300. For example, front surface 312 may be colored or otherwise treated to have a desired appearance (e.g., one or more colors, including a dark color, such as, for example, black; a graphic; text). The internal structure 310 may have visual characteristics inconsistent with the desired appearance (e.g., a different color than front surface 312, for example, white while the front surface 312 is black; or an unfinished or non-uniform appearance). Having the internal structure 310 exposed to view may interrupt or otherwise detract from the desired appearance. In other words, having the internal structure 310 of the material forming the first cord retainer 300 exposed to view by a user may detract from a user experience when interacting with a system including the first cord retainer 300. Thus, it may be desired to hide the internal structure 310 from view.

In some embodiments, to hide the internal structure 310 from view, side edges 316 of the first cord retainer 300 are formed by folds (e.g., along the fold lines 332, see FIG. 12) in the material forming the first cord retainer 300. In this way, the outer surface of the material forming the first cord retainer 300 wraps around and defines the side edges 316, thereby hiding the internal structure 310 from view at the side edges 316. In other words, the internal structure 310 of the material forming the first cord retainer 300 is unexposed along the side edges 316.

An embodiment of a blank 330 usable to form the first cord retainer 300 and its subsequent formation into the first cord retainer 300 are shown in FIGS. 12-17.

Figure 12:
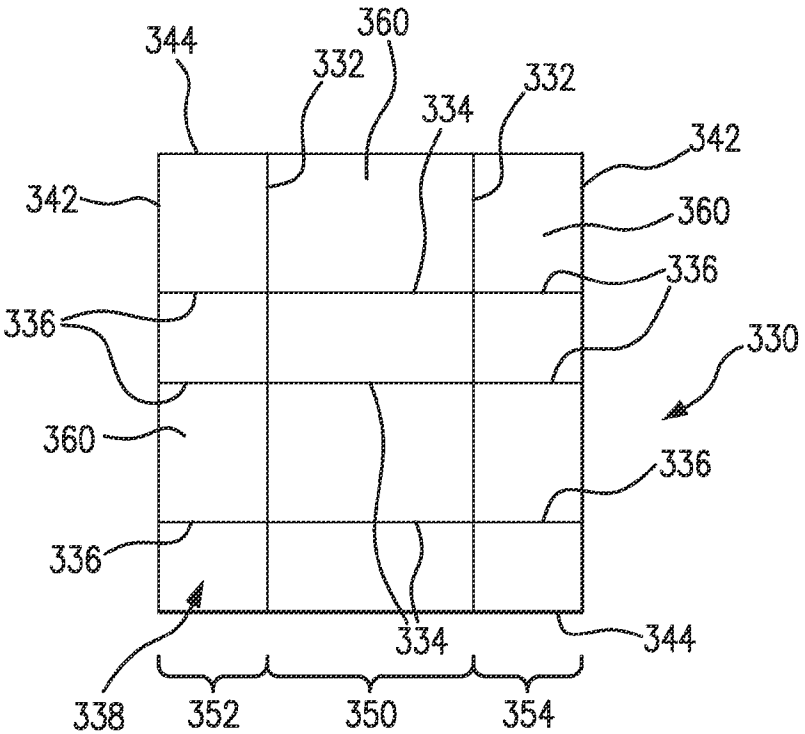
FIG. 12 illustrates a bottom view of a blank used to form a cord retainer, according to an embodiment presented herein.

FIG. 12 shows a blank 330 of material for forming into the first cord retainer 300. The blank 330 includes an inner surface 338. An outer surface 340 opposite inner surface 338 may form the surface of the first cord retainer 300. The blank 330 includes longitudinal fold lines 332, central transverse fold lines 334, and outer transverse fold lines 336. Viewed as shown in FIG. 12, longitudinal fold lines 332 may be upward fold lines, central transverse fold lines 334 may be upward fold lines, and outer transverse fold lines may be downward fold lines.

As shown in FIG. 12, the blank 330 may include a central series 350 of rectangular panels 360, where each panel 360 of the central series 350 of panels is connected to an adjacent panel 360 of the central series 350 of panels 360 by an upward transverse fold line 334. The blank 330 may further include a first outer series 352 of rectangular panels 360, where each panel 360 of the first outer series 352 of panels 360 is connected to an adjacent panel 360 of the first outer series 352 of panels 360 by a downward fold line. The blank 330 may further include a second outer series 354 of rectangular panels 360, where each panel 360 of the second outer series 354 of panels 360 is connected to an adjacent panel 360 of the second outer series 354 of panels 360 by a downward fold line. In some embodiments, the panels 360 of the central series 350 of panels 360 are connected to the panels 360 of the first outer series 352 of panels 360 by an upward longitudinal fold line 332. In some embodiments, the panels 360 of the central series 350 of panels 360 are connected to the panels 360 of the second outer series 354 of panels 360 by an upward longitudinal fold line 332.

In some embodiments, each series of panels 360 (i.e., the central series 350, the first outer series 352, and the second outer series 354) includes four panels 360 (see, e.g., FIG. 12). In some embodiments, each series of panels 360 (i.e., the central series 350, the first outer series 352, and the second outer series 354) includes five panels 360 (see, e.g., FIG. 16). In some embodiments, adjacent panels 360 are continuous across their connections.

In some embodiments, adjacent panels 360 are continuously connected (i.e., are not separated by a cut or other discontinuity in blank 330). In some embodiments, the panels 360 of the central series 350 of panels 360 are continuously connected. In some embodiments, the panels 360 of the first outer series 352 of panels 360 are continuously connected. In some embodiments, the panels 360 of the second outer series 354 of panels 360 are continuously connected. In some embodiments, all panels 360 forming blank 330 are continuously connected to all adjacent panels 360.

Figure 15:
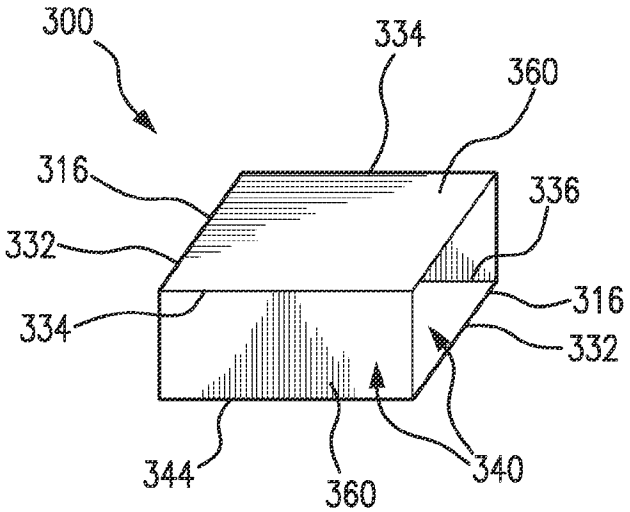
FIG. 15 illustrates a cord retainer formed from the blank of FIG. 12, according to an embodiment presented herein.

The first cord retainer 300 can be formed from the blank 330 by folding the blank 330 along its two longitudinal fold lines 332 such that outer transverse fold lines 336 overlap central transverse fold lines 334 (see, e.g., FIG. 13), and then by folding blank 330 along its at least three overlapping transverse fold lines 334, 336 (see, e.g., FIG. 15).

Figure 13:
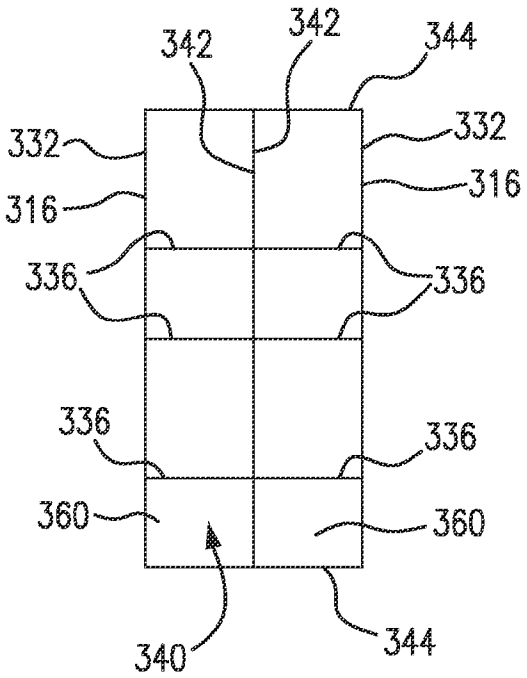
FIG. 13 illustrates the blank of FIG. 12 partially formed into a cord retainer, according to an embodiment presented herein.
Figure 14:
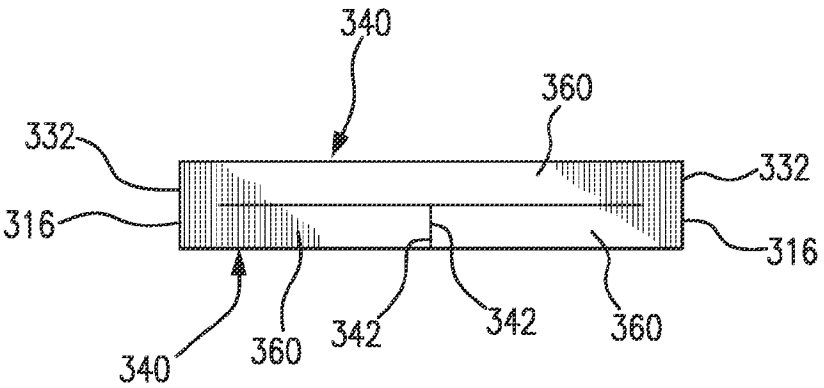
FIG. 14 illustrates an enlarged end view of the blank of FIG. 13, according to an embodiment presented herein.

In some embodiments, longitudinal edges 342 of blank 330 meet after the blank 330 is folded along its longitudinal fold lines 332 (see, e.g., FIGS. 13, 14). In some embodiments, longitudinal edges 342 of blank 330 are spaced apart after the blank 330 is folded along its longitudinal fold lines 332. In some embodiments, longitudinal edges 342 of blank 330 overlap after the blank 330 is folded along its longitudinal fold lines 332. In some embodiments, inner surface 338 may be applied with an adhesive before the blank 330 is folded along its longitudinal fold lines 332, in order to help maintain the folds formed along the longitudinal fold lines 332. In other words, to fix together portions of the blank on opposite sides of each longitudinal fold line upon folding the blank along the two longitudinal fold lines. In some embodiments a fastener other than or in addition to adhesive may be used to help maintain the folds formed along longitudinal fold lines 332, for example, tape or rivets. Use of adhesive as a fastener, however, may provide a more pleasing appearance by minimizing additional elements apparent to a viewer.

In some embodiments, transverse edges 344 of blank 330 meet after the blank 330 is folded along its overlapping transverse fold lines 334, 336 (see, e.g., FIG. 15), forming a seam. In such an embodiment, blank 330 may include four panels 360 in each of its central series 350, first outer series 352, and second outer series 354, the end panels 360 of each series meeting to form the loop. FIG. 12 shows an exemplary such blank 330 including four panels 360 in each series, and FIG. 15 shows an exemplary first cord retainer 300 formed therefrom.

Figure 17:
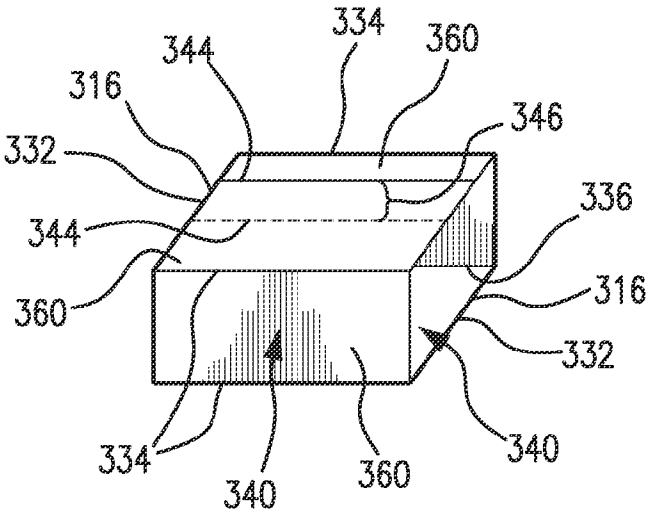
FIG. 17 illustrates a cord retainer formed from the blank of FIG. 16, according to an embodiment presented herein.
Figure 16:
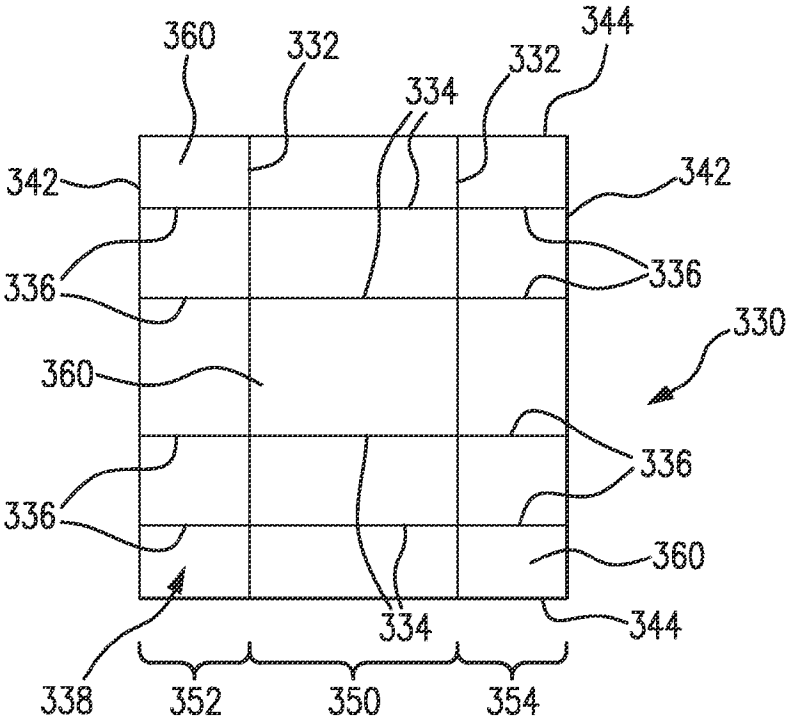
FIG. 16 illustrates a bottom view of a blank used to form a cord retainer, according to an embodiment presented herein.

In some embodiments, transverse edges 344 of blank 330 define an overlap after the blank 330 is folded along its overlapping transverse fold lines 334, 336, forming a seam. In such an embodiment, blank 330 may include five panels 360 in each of its central series 350, first outer series 352, and second outer series 354, the fifth used to establish the overlap with the first. FIG. 16 shows an exemplary such blank 330 including five panels 360 in each series, and FIG. 17 shows an exemplary first cord retainer 300 formed therefrom, having an overlap 346. In some embodiments, the overlap 346 may be maintained by a fastener, such as, for example, adhesive, tape, or rivets. Use of adhesive as a fastener, however, may provide a more pleasing appearance by minimizing additional elements apparent to a viewer.

In addition to hiding the internal structure 310 of the material forming the first cord retainer 300, the above-described configuration of the first cord retainer 300 having folds defining its side edges 316 contributes to the structural stability of the first cord retainer 300. For example, the folds may cause the panels 360 to overlap, providing the cord retainer with a two-ply structure, which may be thicker and more robust than would be a single-ply structure. Furthermore, the folds may provide greater resistance to tearing and otherwise deforming than would edges defined by exposed internal structure 310.

In some embodiments, the second coiled cord 250 is retained in shape by a wrapping member, such as, for example, a second cord retainer 390. In some embodiments, the second cord retainer 390 is a preformed plastic strip that encourages the coiled cord 250 to remain in its coiled configuration. In some embodiments, the second cord retainer 390 can be formed of oriented polypropylene (OPP) or other material with characteristics suitable for maintaining the shape of the second coiled cord 250. In some embodiments, the second cord retainer 390 is transparent. In some embodiments, the second cord retainer is opaque or translucent. In some embodiments, the second cord retainer is a single-ply loop of flat material, which meets or overlaps at opposing ends thereof to form a loop (e.g., a rectangular loop). The second cord retainer 390 may retain the second coiled cord 250 in any desired configuration, including those described above for the first coiled cord 200. For example, in some embodiments, the second coiled cord 250 defines a coil shape having two parallel offset straight sections and two opposing semicircular sections, where the semicircular sections extend between and connect the straight sections.

In some embodiments, the second cord retainer 390 may be formed similarly as described above with respect to the first cord retainer 300. In some embodiments, the first cord retainer 300 may be formed similarly as described above with respect to the second cord retainer 390.

Figure 3:
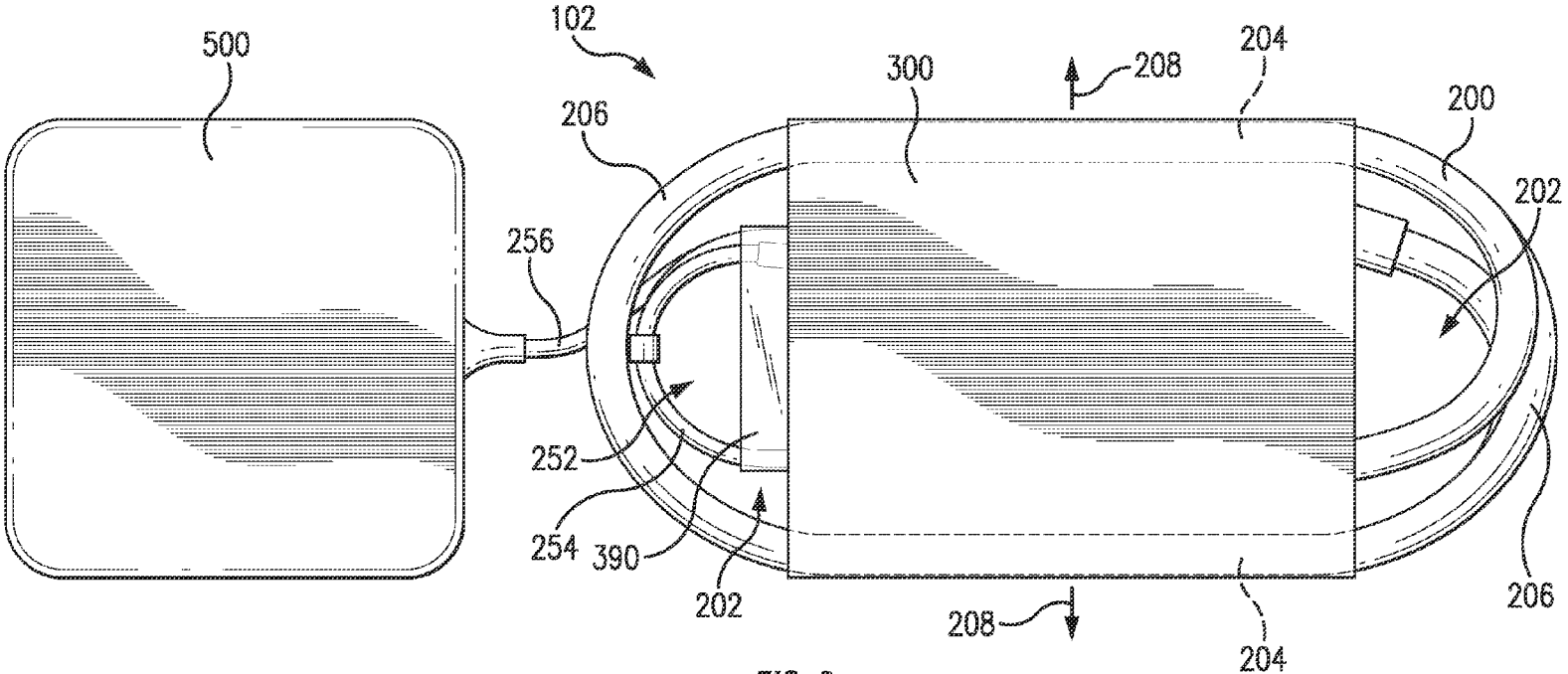
FIG. 3 illustrates a top view of a cord and retainer system, according to an embodiment presented herein.
Figure 4:
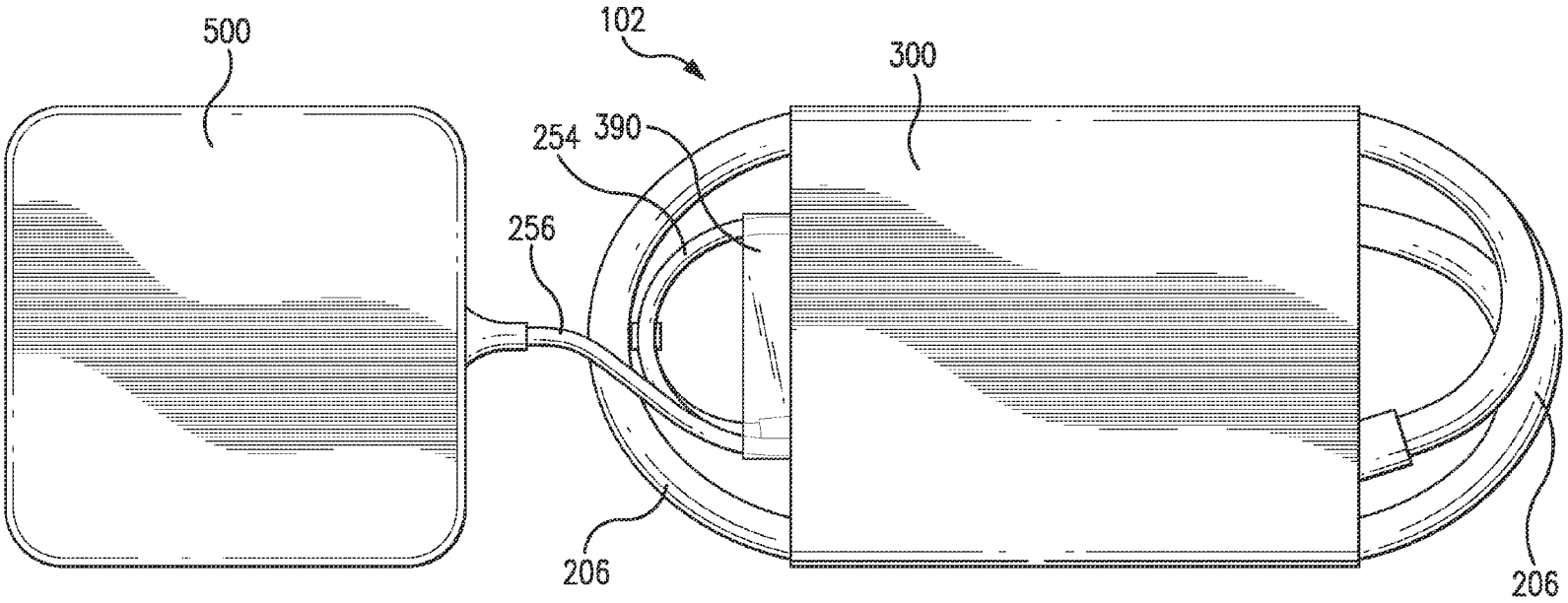
FIG. 4 illustrates a bottom view of a cord and retainer system, according to an embodiment presented herein.

In some embodiments, where the second coiled cord 250 is nested within the first coiled cord 200, the second coiled cord 250 extends within the loop formed by the first cord retainer 300 disposed about the first coiled cord 200 (see, e.g., FIG. 3).

A cord and retainer system according to some embodiments includes a packaging substrate (e.g., the packaging substrate 400). The packaging substrate 400 may include one or more cavities (e.g., cavities 402, 404 shown in FIG. 1). In some embodiments, one or both of the first coiled cord 200 and the second coiled cord 250 may be disposed in a cavity 402. In some embodiments, the first coiled cord 200 and the second coiled cord 250 may be nested together and disposed in the cavity 402. The cavity 402 may be sized and/or shaped to correspond to desired outer extents of the first coiled cord 200. In some embodiments, where the first cord retainer 300 includes a seam (e.g., from the transverse edges 344 of blank 330 meeting or overlapping after the blank 330 is folded along its overlapping transverse fold lines 334, 336), the first cord retainer 300 may be positioned such that the seam faces downward into the cavity, and is thus not viewable from outside the cavity.

In some embodiments, the electronic component 500 may be disposed within the cavity 404. The cavity 404 may be sized and/or shaped to correspond to desired outer extents of the electronic component 500. In some embodiments, the cavity 402 and the cavity 404 may be connected by a channel 406, and the uncoiled portion 256 of the second coiled cord 250 may extend through the channel 406 to connect to the coiled portion 254 to the electronic component 500.

In some embodiments, the packaging substrate 400 may be, for example, a thermoformed sheet, where cavities have been thermoformed therein. In some embodiments, the packaging substrate 400 may be, for example, a solid block of material, where cavities have been formed by removing portions of such material.

Figure 18:
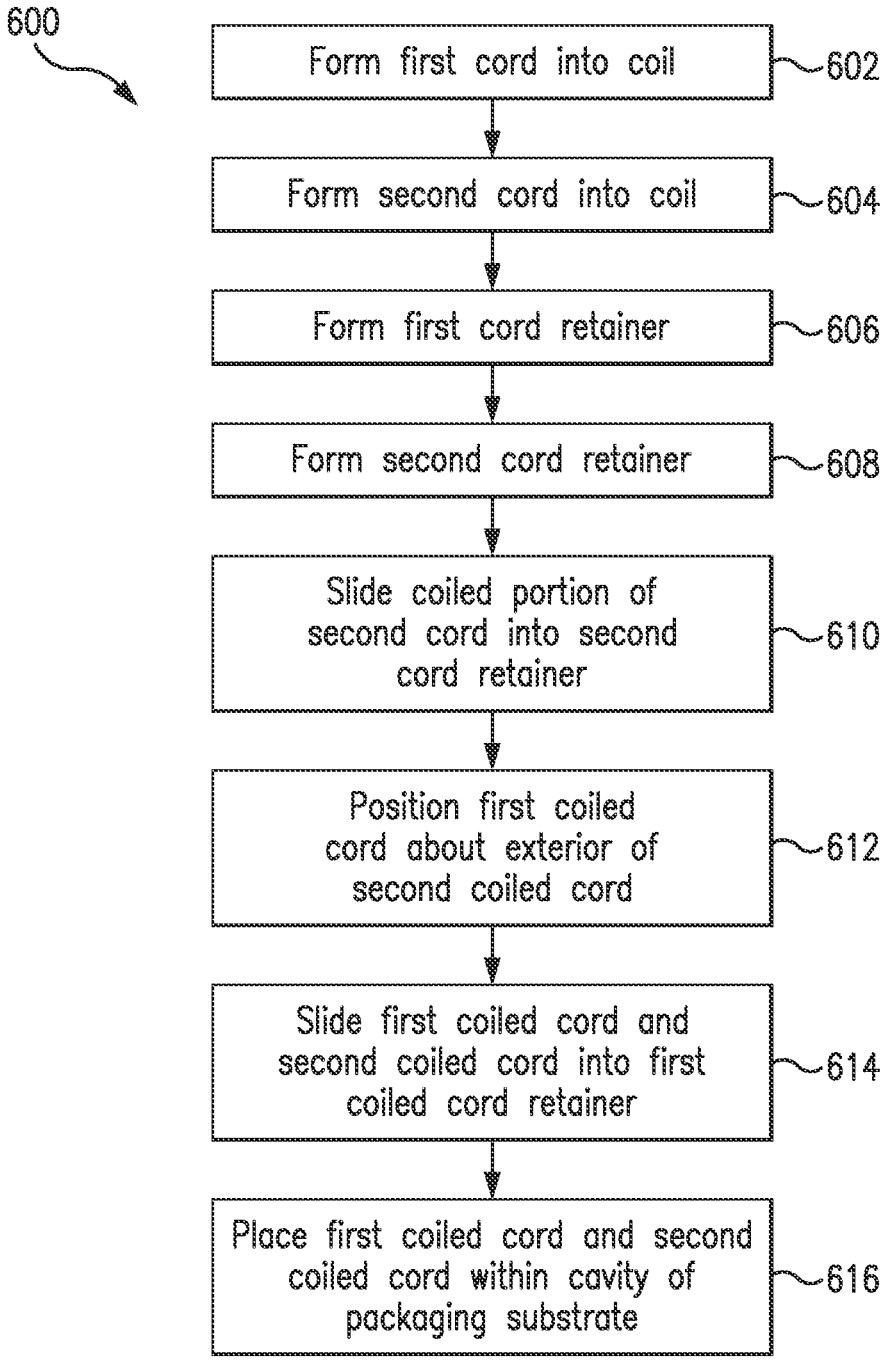
FIG. 18 is a flow chart showing operations to assemble a cord and cord retainer system according to an embodiment presented herein.

A cord and cord retainer system according to some embodiments can be assembled by an assembly procedure 600, represented in FIG. 18. The assembly procedure 600 may include the following operations:

Forming the first cord 200 into a coil having vertically-aligned windings (e.g., by winding the cord a plurality of times about a frame sized to define a desired interior size and/or shape of the coil of the first coiled cord 200). See operation 602, FIG. 18.

Forming the second cord 250 into a coil having vertically-aligned windings (e.g., by winding the cord a plurality of times about a frame sized to define a desired interior size and/or shape of the coil of the second coiled cord 250). In some embodiments, an uncoiled portion of the second coiled cord 250 (e.g., the uncoiled portion 256) may extend outside the coil of the second coiled cord 250 to connect to (or terminate in) the electronic component 500. See operation 604, FIG. 18.

Forming the first cord retainer 300 (e.g., as described above). See operation 606, FIG. 18.

Forming the second cord retainer 390 (e.g., as described above). See operation 608, FIG. 18.

Sliding the coiled portion 254 of the second coiled cord 250 into the second cord retainer, compressing the second coiled cord 250 if necessary to fit within the second cord retainer 390. See operation 610, FIG. 18.

Positioning the first coiled cord 200 about the exterior of the second coiled cord 250, such that the coiled portion 254 of the second coiled cord 250 is encircled by the first coiled cord 200, the electronic component 500 is disposed outside the coil of the first coiled cord 200, and the uncoiled portion 256 of the second coiled cord 250 extends from within to without the coil of the first coiled cord 200. See operation 612, FIG. 18.

Sliding the first coiled cord 200 and the coiled portion of the second coiled cord 250 into the first cord retainer 300, compressing the first coiled cord 200 if necessary to fit within the first cord retainer 300. See operation 614, FIG. 18.

Placing the first coiled cord 200, second coiled cord 250, first cord retainer 300, second cord retainer 390, and electronic component 500 together within one or more cavities of a packaging substrate. See operation 616, FIG. 18.

The foregoing description of the specific embodiments of the cord and retainer system and associated methods described with reference to the figures will so fully reveal the general nature of the invention that others can, by applying knowledge within the skill of the art, readily modify and/or adapt for various applications such specific embodiments, without undue experimentation, without departing from the general concept of the present invention. For example, in some embodiments, the second coiled cord 250 may not be nested within the first coiled cord 200. In such an embodiment, the second coiled cord may be placed within a separate cavity of the packaging substrate 400 from the cavity 402 for containing the first coiled cord 200.

Also for example, the cords described in the above embodiments were described generally as power cords. This is for clarity, and not meant to be limiting. Embodiments may also apply to any other type of cord, including, for example, audio cords, video cords, telephone cords, cable cords, fiber-optic cords, and non-electric cords (e.g., rope, paracord).

Also for example, the cord and retainer systems of the above embodiments were described to have one or two cords. Some embodiments, however, may include more than two cords. In some embodiments, for example, in a nested configuration the first coiled cord 200 encircles more than one second coiled cord 250. In some embodiments, two or more second coiled cords 250 encircled by the first coiled cord 200 may themselves be nested together (e.g., one of the second coiled cords 250 may be encircled by another of the second coiled cords 250).

While various embodiments have been described above, they have been presented by way of example only, and not limitation. It should be apparent that adaptations and modifications are intended to be within the meaning and range of equivalents of the disclosed embodiments, based on the teaching and guidance presented herein. It therefore will be apparent to one skilled in the art that various changes in form and detail can be made to the embodiments disclosed herein without departing from the spirit and scope of the present invention. The elements of the embodiments presented above are not necessarily mutually exclusive, but may be interchanged to meet various needs as would be appreciated by one of skill in the art.

It is to be understood that the phraseology or terminology used herein is for the purpose of description and not of limitation. The breadth and scope of the present invention should not be limited by any of the above-described exemplary embodiments, but should be defined only in accordance with the following claims and their equivalents.

What is claimed is:

1. A cord and retainer system comprising:

a first coiled cord having a plurality of coil windings;

a second coiled cord separate from the first coiled cord, having a plurality of coil windings, wherein the second coiled cord is encircled by the first coiled cord; and packaging for retaining the first coiled cord and the encircled second coiled cord, wherein the coil axis of the first coiled cord is offset from the coil axis of the second coiled cord.

2. The cord and retainer system of claim 1, wherein the first coiled cord and the second coiled cord are configured to mate together by connectors thereof.

3. The cord and retainer system of claim 1, wherein at least one of the first coiled cord and the second coiled cord define vertically-aligned coil windings.

4. The cord and retainer system of claim 1, wherein both the first coiled cord and the second coiled cord define vertically-aligned coil windings.

5. The cord and retainer system of claim 1, wherein the second coiled cord is connected to an electronic element disposed outside the coil windings of the first coiled cord.

6. The cord and retainer system of claim 1, wherein the packaging comprises a substrate defining a cavity, wherein the first coiled cord and the second encircled coiled cord are disposed within the cavity.

7. The cord and retainer system of claim 1, wherein the packaging comprises a cord retainer, formed into a loop, disposed about the first coiled cord.

8. The cord and retainer system of claim 7, wherein the loop is formed by overlapping ends of a flat sheet.

9. The cord and retainer system of claim 7, wherein edges of the loop are formed by folds in a flat sheet.

10. A blank for forming a cord retainer, the blank comprising:

a central series of rectangular panels, each panel of the central series of panels connected to an adjacent panel of the central series of panels by an upward fold line;

a first outer series of rectangular panels, each panel of the first outer series of panels connected to an adjacent panel of the first outer series of panels by a downward fold line; and a second outer series of rectangular panels, each panel of the second outer series of panels connected to an adjacent panel of the second outer series of panels by a downward fold line, wherein the central series of panels is connected to the first outer series of panels by an upward fold line along a first side of the central series of panels, wherein the central series of panels is connected to the second outer series of panels by an upward fold line along a second side of the central series of panels, and wherein the downward fold lines connecting the first outer series of panels and the downward fold lines connecting the second outer series of panels are aligned with the upward fold lines connecting the central series of panels.

11. The blank of claim 10, wherein the central series of panels comprises four rectangular panels, wherein the first outer series of panels comprises four rectangular panels, and wherein the second outer series of panels comprises four rectangular panels.

12. The blank of claim 10, wherein the central series of panels comprises five rectangular panels, wherein the first outer series of panels comprises five rectangular panels, and wherein the second outer series of panels comprises five rectangular panels.

13. The blank of claim 10, wherein the central series of panels, the first outer series of panels, and the second outer series of panels are continuously connected.

14. The blank of claim 10, wherein the blank defines a rectangular shape.

15. A method for assembling a cord and retainer system, the method comprising:

forming a first cord into a coil;

forming a second cord into a coil, wherein the second cord formed into a coil has a coiled portion and an uncoiled portion extending from the coiled portion to an electronic component;

forming a first cord retainer;

forming a second cord retainer;

sliding the coiled portion of the second cord into the second cord retainer;

positioning the coil of the first cord about the exterior of the coiled portion of the second cord; and sliding the first cord and the coiled portion of the second cord into the first cord retainer.

16. The method of claim 15, further comprising:

placing the first cord, second cord, first cord retainer, second cord retainer, and electronic component together within one or more cavities of a packaging substrate.

17. The method of claim 15, wherein forming the first cord into a coil comprises forming the first cord into a coil comprising vertically-aligned windings.

18. The method of claim 15, wherein forming the first cord retainer comprises:

folding a blank along two longitudinal fold lines; and folding the blank along at least three transverse fold lines to form a loop.

19. The method of claim 18, wherein forming the first cord retainer comprises:

fixing portions of the blank on opposite sides of each longitudinal fold line together upon folding the blank along the two longitudinal fold lines.

* * * * *